US005452848A

United States Patent [19]

Mur Gimeno

[11] Patent Number: 5,452,848

[45] Date of Patent: Sep. 26, 1995

[54] STACKABLE CONTAINER

[75] Inventor: D. Emilio Mur Gimeno, Alicante, Spain

[73] Assignee: Iberoamericana Del Embalaje, S.A., Spain

[21] Appl. No.: 214,959

[22] Filed: Mar. 16, 1994

[30] Foreign Application Priority Data

Mar. 16, 1993 [ES] Spain ..... 9300689

[51] Int. Cl.[6] ..... B65D 5/20; B65D 5/42

[52] U.S. Cl. ..... 229/191; 229/918

[58] Field of Search ..... 229/191, 915, 229/918, 919

[56] References Cited

U.S. PATENT DOCUMENTS

| | | | |
|---|---|---|---|
| 3,883,067 | 5/1975 | McGlynn et al. | 229/919 |
| 3,940,053 | 2/1976 | Putman et al. | 229/915 |
| 4,373,659 | 2/1983 | Cornell et al. | 229/915 |
| 4,883,221 | 11/1989 | Brundage | 229/918 |
| 5,000,377 | 3/1991 | McClure | 229/919 |
| 5,002,224 | 3/1991 | Muise | 229/918 |

FOREIGN PATENT DOCUMENTS

| | | | |
|---|---|---|---|
| 2223988 | 10/1974 | France | 229/918 |
| 2453082 | 10/1980 | France | 229/191 |
| 2651482 | 3/1991 | France | 229/919 |

*Primary Examiner*—Gary E. Elkins
*Attorney, Agent, or Firm*—Ostrolenk, Faber, Gerb & Soffen

[57] ABSTRACT

A stackable container formed from a sheet of material that is die-cut, for example, and folded to form an open box having a bottom, side walls, and end walls having extensions. Crests formed on the upper edges of the end walls and the extensions provide double-thickness crests when the extensions are folded back onto the inside of the end walls. The double-thickness crests fit into corresponding holes made in the lower edges of the end walls of the open box, such that another similar box can be set securely on the upper edges of the box. Thus, a plurality of boxes can be superimposed, fitting one on top of another, to form stable stacks. The extensions are divided vertically into a first section, a central section and a final section. The extensions are folded inside the box to form prism-shaped reinforcements, the central sections being folded at an oblique angle across the corners of the box. In addition, flaps in the end walls between the final sections fold toward the bottom from the upper edges to form a double thickness with the end walls. Preferably, the side walls of the box are shorter than the end walls to allow ventilation through the box when the boxes are stacked.

8 Claims, 2 Drawing Sheets

11
7
8
12
3
13
14
9
10
2
2
1
6
5
4
3

STACKABLE CONTAINER

BACKGROUND OF THE INVENTION

1. Field of the Invention

The invention covers an improved stackable container in which the short ends are noticeably reinforced and have on their upper edge two specially reinforced crests that allow various boxes to be superimposed, forming very stable and resistant stacks. The most specific application for the model is to package perishable products such as fruit and vegetables.

2. Description of the Related Art

Various models of open containers or boxes are known in the market, formed from a sheet of material that can be die cut, usually corrugated cardboard, and which have some means to allow various boxes to be superimposed and fit into each other to form stacks.

Among this type of box, note should be made of utility model 289.749 owned by the company IBEROAMERICANA DEL EMBALAJE, S.A., the applicant for the present model, that offers the unusual fact that, from the upper edge of each corner a crest emerges forming a dihedral angle, the wings of which extend over the walls of the short side and long side respectively. Coinciding with these crests, the corners of the lower edge have angular orifices, all of which means that when the boxes are superimposed the crests of the lower box fit into the orifices formed in the box situated on the immediately superior plain. The boxes thus filled allow stacks of considerable height to be formed.

Although this type of tray is very appropriate for the storage and transport of perishable products, in some cases the load thus formed is unbalanced and the stack falls, damaging the packaged products. Such an accident may occur because the lowest box is subject to maximum vertical pressure from the whole stack, and this lowest box does not support its corners on the base that supports the whole stack and in many cases this causes a lack of equilibrium and consequent fall.

The present model proposes a new, improved container, which is intended to solve the very important problem indicated.

SUMMARY OF THE INVENTION

The object of the present utility model, as indicated above, is a new container that has been improved in its design characteristics of organization and mounting, which is constructed and mounted with relative ease with the use of a minimum of labor, which ensures that a good quality box is obtained of relatively inexpensive to manufacture.

A characteristic of the model is the longer sides of the box having a piece removed from the upper edge, which forms a wide space between two superimposed boxes which gives the necessary ventilation for packaged perishable articles.

According to another characteristic of the model, each corner of the box has triangular prisms that form very resistant supports, on which the box above it will rest.

A further characteristic of the model foresees that on both sides of the short ends are extensions with transverse scored lines that mark three successive sections that turn towards the inside of the tray to form the support prisms in each corner of the box, and of which the final section is turned to form an obtuse angle with the previous section to lie against and be glued to the internal face of the short end with which it forms a double wall giving a noticeable reinforcement.

Another characteristic of the model is that between the final sections of the lateral extensions of the short ends, and facing each other, a flap is fitted that is bent on the upper edge of each short end to reinforce it.

Yet another characteristic of the model is that the end wings of the extensions of the short ends have on their upper edge a crest that forms part of the means for fitting one tray into another.

Another characteristic of the model is that from the upper edge of each short end are two raised crests against each of which lies the crest emerging from the end section of the lateral extensions of the short end itself.

An object of the model is to form a container with means of support and connection between superimposed boxes to form a stack.

Another object of the model is to offer a container of the open box type in which, in order to form a connection between every two superimposed boxes, their corners are kept firm, thus avoiding the fall of one of them destabilizing the stack in which it is included.

Other details related to the benefits and economics of the model will be shown during the following description that is illustrated by two sheets of drawings attached in which, somewhat schematically and solely as an example that implies no limitation, the details and overall layout preferred for the idea of the model are shown, referring to a possible practical example.

DESCRIPTION OF THE PREFERRED EMBODIMENT

Figure 1:
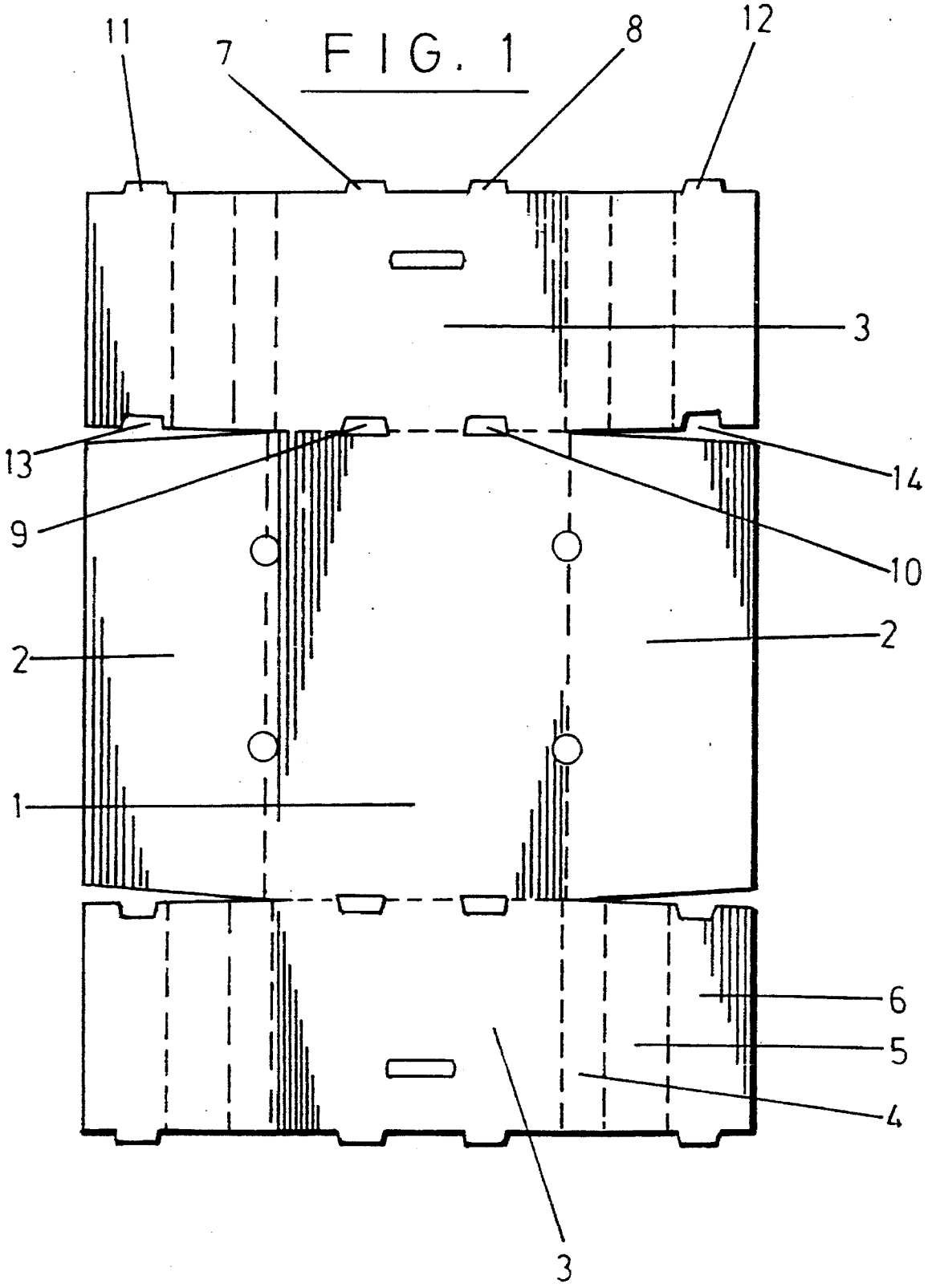
FIG. 1 shows a blank for forming the container according to a preferred embodiment of the present invention, wherein the corners of the bottom form an integral part with the long and short sides.

FIG. 1 shows the development of the container in which it can be seen that the corners of the bottom form an integral part with the long and short sides, and therefore when the corners or the box are formed there will be full support without any failures due to cut out areas. Similarly the drawing shows that both the short ends and their lateral extensions have crests that lie two by two, to form connection salients separate from the corners of the box that remain whole.

Figure 2:
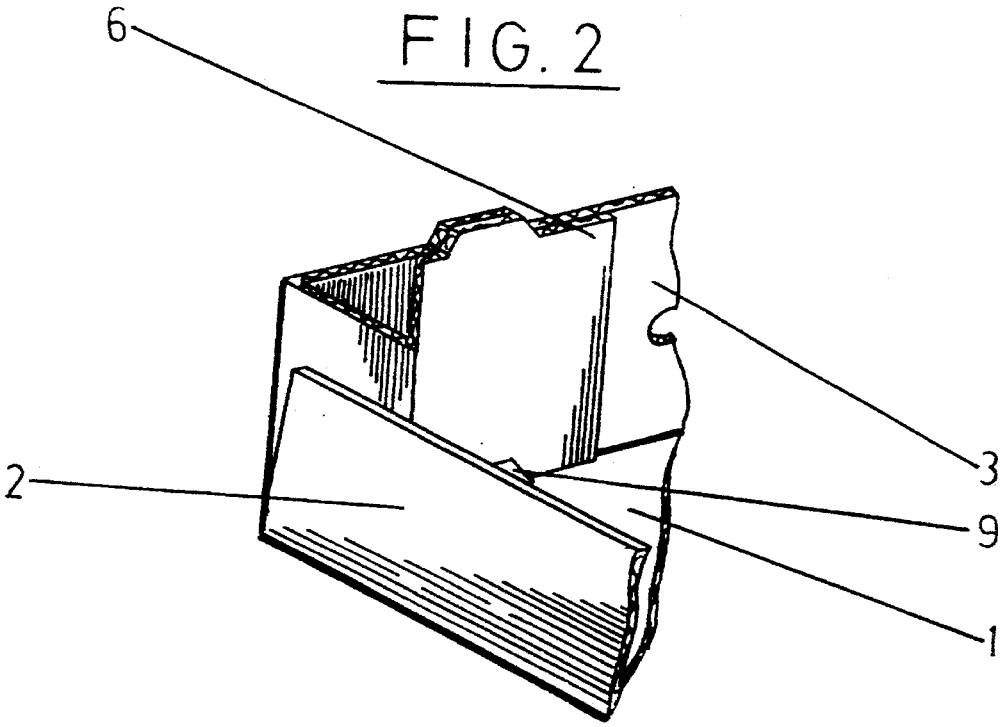
FIG. 2 is a view in perspective showing a corner of the box when formed, according to a preferred embodiment of the present invention.

FIG. 2 is a view in perspective showing a corner of the box when formed.

In this drawing the following details can be seen:

a) The long sides of the box have less height than the short ends, to form ventilation spaces between two superimposed boxes.

b) In each corner of the box, a triangular prism is formed by the rolling of the extensions on the short sides, that noticeably reinforces the box and forms a point or support on which the box placed immediately above will rest.

c) The short ends are reinforced not only by the prism formed in the corners, but also by the end sections of the lateral extensions of the short sides which fit against and adhere to the internal face of the short sides, to reinforce them.

d) From the upper edge of each short side emerge two crests of double thickness of material and to coincide with these crests the bottom and wall have cutouts so that when the boxes are superimposed the crests emerging from each box enter with a smooth fit into the coinciding cut out in the box placed immediately above.

Figure 3:
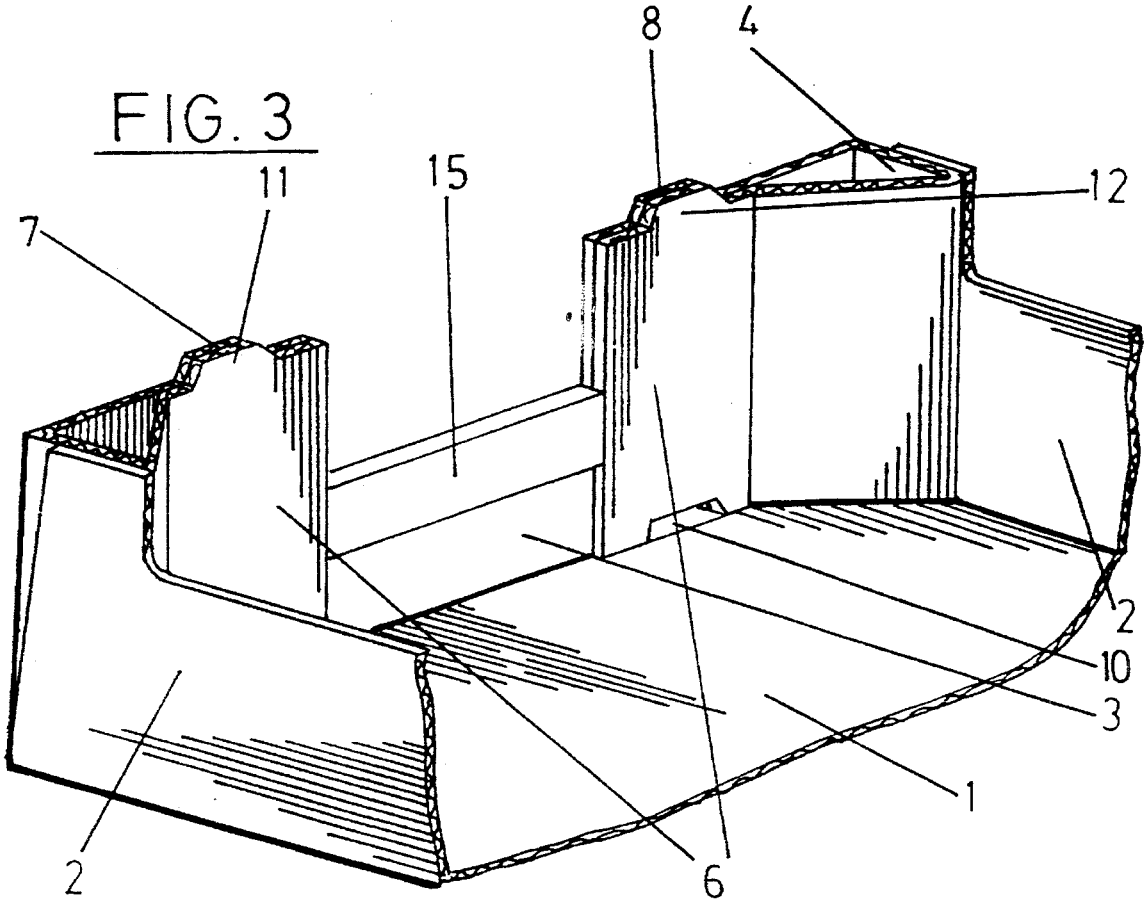
FIG. 3 is a breakdown view of a box, formed according to a preferred embodiment of the invention, showing the reinforced corners, the end wall flaps, and the crests to fit one box over another.

FIG. 3 is a breakdown view of a box, formed according to the invention, showing the organization of the reinforced corners and the layouts to fit one box over another.

Commenting on these drawings, it should be clarified that n° -1- indicates the bottom of the container, which is normally rectangular in shape and on whose longest sides are bent the longest ends shown as n° -2-; both the bottom and long sides are regular and have no special characteristics. The long sides have a lesser height than the short sides, or have a piece cut from the central part of the upper edge, so that by this difference in height between the short and long sides, the necessary space is formed between the stacked boxes to ventilate the packaged products.

The short sides shown as n° -3- have extensions on both sides that are divided by fold lines into three successive sections, parallel with each other, indicated by number -4-, -5- and -6-, which are folded to form a triangular prism with the two numbered -4- and -5- in each corner of the box, to reinforce the box and also serve as a support on point on which one box will rest on another when stacked.

The first section -4-, which when turned will form a dihedral angle of 90° with the short end, and will lie against and be joined by gluing to the long side -2-, thus forming the container. The second section -5- of the mentioned extensions is placed transversely between the long side -2- and the short side -3-, closing the corresponding angle of the box and forming the mentioned support, and its placement is fixed by the last section -6- which is bent to form an obtuse angle with the transverse section -5- and is applied and joined by gluing to the internal face of the short side -3-, forming with it a double wall and creating on the upper edge of both a continuation of the seating prism mentioned.

From the upper edge of each short end emerge two crests, -7- and -8- and coinciding with these, in the lower edge of the short side, two holes -9- and -10- have been cut extending into the short end -3- and the base -1-.

The end sections -6- of the lateral extensions of the short ends have on their upper edges two crests -11- and -12- with the same configuration and size as the crests -7- and -8- of the short sides -3-. When the lateral extensions of each short side are turned and their end section -6- rests against the inside face of the short side, the crests -11- and -12- rest on the crests -7- and -8- of the short side, thus forming prominences on the upper border of the box with double thickness of material which are very strong and form a safe connection between superimposed boxes.

The containers thus organised have two holes cut in the lower border -9- and -10- that are made in the short sides and the bottom, and these holes are intended to take the crests -7-, -11- and -8-, -12- of another box that is situated immediately below.

The final section -6- of the lateral extensions of the short sides, has two cutouts -13- and -14- on its lower edge that coincide respectively with the holes -9-, -10- that form the connection holes for the crests emerging from the edge of the short ends.

Referring again to FIG. 3, it can be seen that the short ends -3- may in some cases have in the center of the upper part a partially bent section -15- that is folded towards the inside of the container and fitted against and glued to the short end -3- of which it forms a part, thus making with the latter a double wall situated between the end sections -4- of the lateral extensions of the short ends.

This formation is most appropriate for packaging perishable products that are relatively heavy and compact such as melons, water melons and others that may require packaging in a box with strong walls.

The container model described is not limited exclusively to the manner of realization commented on, since when put into practice there may be modifications in the details, provided these do not alter the essence of the object described.

I claim:

1. A stackable container formed from a sheet of material that is die cut and folded to form an open box having an inside, a bottom, side walls, and end walls, the end walls having upper edges, lower edges, opposed sides, a thickness and a height, the container comprising:

first crests formed on the upper edges of the end walls, the crests being spaced apart;

extensions extending laterally from the opposed sides of the end walls and having upper edges aligned with the upper edges of the end walls, each extension being vertically divided into a first section, a central section and a final section, the sections being successive and marked by fold lines, with the final sections being folded against the inside of the end walls;

second crests formed on the upper edge of the final section of each extension, the second crests coinciding with respective ones of the first crests on the upper edges of the end walls to form double-thickness crests;

cut outs in the lower edges of the end walls coinciding in position with the double-thickness crests on the upper edges of the end walls and the end-wall extensions; and flaps in the end walls disposed between the final sections and folded toward the bottom of the box from the upper edge of the end walls and adhered to the end walls to form a double thickness between the final sections.

2. A stackable container, according to claim 1, wherein the final section of each lateral extension of the end walls is adhered to the end walls.

3. A stackable container, according to claim 1, wherein the end walls and the side walls meet to form corners, and the central sections of the extensions of the end walls are folded to form diagonals across the corners.

4. A stackable container, according to claim 1, wherein:

the end walls and the side walls meet to form corners;

the first sections of the extensions of the end walls are folded to lie inside the box and against respective ones of the side walls; and the central sections are folded to form diagonals across the corners.

5. A stackable container, according to claim 1, wherein the side walls have a height which is shorter than the height of the end walls.

6. A stackable container formed from a sheet of material that is die cut and folded to form an open box having an inside, a bottom, side walls, and end walls, the end walls having upper edges, lower edges, opposed sides, a thickness and a height, the side walls and end walls meeting to form corners, the container comprising:

first crests formed on the upper edges of the end walls, the crests being spaced apart;

extensions extending laterally from the opposed sides of the end walls and having upper edges aligned with the upper edges of the end walls, each extension being vertically divided into a first section, a central section and a final section, the sections being successive and marked by fold lines, the first sections being folded inside the box against respective ones of the side walls and the central sections being folded at an oblique angle across each of the corners to form prism-shaped reinforcements, and the final sections being folded inside the box, away from the respective side walls and adhered to the end walls;

second crests formed on the upper edge of the final section of each extension, each second crest coinciding with a respective on of the first crests on the upper edges of the end walls to form double-thickness crests; and cut outs in the lower edges of the end walls coinciding in position with the double-thickness crests on the upper edges of the end walls.

7. A blank for forming a stackable container from a single sheet of material, the formed container having a bottom, side walls, and end walls, the end walls having upper edges, lower edges, opposed sides, and a thickness and a height, the blank comprising:

first crests formed on the upper edges of the end walls, the crests being spaced apart;

extensions extending laterally from the opposed sides of the end walls and having upper edges aligned with the upper edges of the end walls, the extensions being divided into a first section, a central section and a final section, the sections being successive and marked by fold lines;

second crests formed on the upper edge of the final section of each extension, the second crests coinciding with respective ones of the first crests on the upper edges of the end walls to form double thickness crests; and cut outs formed in the lower edges of the end walls coinciding in position with the first and second crests on the upper edges of the end walls and the upper edges of the final sections of the end-wall extensions.

8. The blank of claim 7, further comprising flaps cut in the end walls for folding toward the bottom from the upper edge to form a double thickness on the end walls between the final sections.

* * * * *